US011788013B2

(12) United States Patent
Pradeep et al.

(10) Patent No.: US 11,788,013 B2
(45) Date of Patent: Oct. 17, 2023

(54) PROCESS FOR PRODUCTION OF NEEDLE COKE

(71) Applicant: INDIAN OIL CORPORATION LIMITED, Maharashtra (IN)

(72) Inventors: Ponoly Ramachandran Pradeep, Faridabad (IN); Shivam Ashok Dixit, Faridabad (IN); Prantik Mondal, Faridabad (IN); Jitumoni Brahma, Faridabad (IN); Rajesh, Faridabad (IN); Terapalli Hari Venkata Devi Prasad, Faridabad (IN); Satyen Kumar Das, Faridabad (IN); Madhusudan Sau, Faridabad (IN); Gurpreet Singh Kapur, Faridabad (IN); Sankara Sri Venkata Ramakumar, Faridabad (IN)

(73) Assignee: INDIAN OIL CORPORATION LIMITED, Mumbai (IN)

( * ) Notice: Subject to any disclaimer, the term of this patent is extended or adjusted under 35 U.S.C. 154(b) by 0 days.

(21) Appl. No.: 17/478,692

(22) Filed: Sep. 17, 2021

(65) Prior Publication Data

US 2022/0089955 A1 Mar. 24, 2022

(30) Foreign Application Priority Data

Sep. 18, 2020 (IN) ..... 202021040506

(51) Int. Cl.
*C10B 57/08* (2006.01)
*C10B 55/00* (2006.01)
(Continued)

(52) U.S. Cl.
CPC ..... *C10B 57/08* (2013.01); *C10B 55/00* (2013.01); *C10B 57/02* (2013.01); *C10G 7/00* (2013.01);
(Continued)

(58) Field of Classification Search
CPC ..... C10B 57/08; C10B 57/02; C10B 55/00; C10G 7/00; C10G 9/005; C10G 11/16;
(Continued)

(56) References Cited

U.S. PATENT DOCUMENTS 2,775,549 A * 12/1956 Shea, Jr. ..... C10B 55/00 208/50
3,704,224 A * 11/1972 Scovill ..... C10B 55/00 208/50
(Continued)

FOREIGN PATENT DOCUMENTS

CN 1309164 A 1/2003

OTHER PUBLICATIONS

Eser et al. "A Laboratory Study of a Pretreatment Approach to Accommodate High-Sulfur FCC Decant Oils asFeedstocks for Commercial Needle Coke" Sep. 2007.
(Continued)

*Primary Examiner* — Michelle Stein
(74) *Attorney, Agent, or Firm* — Maschoff Brennan

(57) ABSTRACT

High-quality graphite/needle grade coke is produced with reduced impurity levels and improved coefficient of thermal expansion using an integrated hydrotreatment, catalytic cracking and coking reaction sections, employing a combination of highly paraffinic hydrotreated VGO stream and aromatic CLO stream, which is thereafter processed in a delayed coking section.

8 Claims, 1 Drawing Sheet

(51) Int. Cl.

| | |
|---|---|
| ***C10B 57/02*** | (2006.01) |
| ***C10G 7/00*** | (2006.01) |
| ***C10G 9/00*** | (2006.01) |
| ***C10G 11/16*** | (2006.01) |
| ***C10G 31/09*** | (2006.01) |
| ***C10G 45/02*** | (2006.01) |
| ***C10G 67/14*** | (2006.01) |
| ***C10G 67/16*** | (2006.01) |

(52) U.S. Cl.
CPC ..... *C10G 9/005* (2013.01); *C10G 11/16* (2013.01); *C10G 31/09* (2013.01); *C10G 45/02* (2013.01); *C10G 67/14* (2013.01); *C10G 67/16* (2013.01); *C10G 2300/1074* (2013.01); *C10G 2300/1096* (2013.01); *C10G 2300/202* (2013.01); *C10G 2300/4081* (2013.01); *C10G 2400/06* (2013.01)

(58) Field of Classification Search
CPC ..... C10G 31/09; C10G 45/02; C10G 67/14; C10G 67/16; C10G 2300/1074; C10G 2300/1096; C10G 2300/202; C10G 2300/4081; C10G 2400/06
See application file for complete search history.

(56) References Cited

U.S. PATENT DOCUMENTS

| | | | | |
|---|---|---|---|---|
| 3,769,200 | A * | 10/1973 | Folkins | C10B 55/00 208/53 |
| 4,075,084 | A | 2/1978 | Skripek et al. | |
| 4,213,846 | A * | 7/1980 | Sooter | C10B 55/00 208/131 |
| 4,466,883 | A * | 8/1984 | Eickemeyer | C10B 55/00 208/50 |
| 4,720,338 | A | 1/1988 | Newman et al. | |
| 4,919,793 | A * | 4/1990 | Mallari | C10B 55/00 208/132 |
| 5,286,371 | A | 2/1994 | Goval et al. | |
| 5,645,711 | A * | 7/1997 | Hraban | C10G 69/02 208/50 |
| 5,695,631 | A | 12/1997 | Eguchi et al. | |
| 5,871,635 | A * | 2/1999 | Gupta | C10G 47/16 208/89 |
| 9,375,656 | B2 | 6/2016 | Subbiah et al. | |
| 2005/0284793 | A1* | 12/2005 | Bhattacharyya | C10G 9/005 208/67 |
| 2009/0057196 | A1* | 3/2009 | Leta | C10B 55/00 208/85 |
| 2009/0127161 | A1* | 5/2009 | Haizmann | C10G 47/00 208/59 |
| 2009/0266742 | A1* | 10/2009 | Newman | C10G 9/16 208/131 |
| 2009/0294327 | A1* | 12/2009 | Miller | C10B 57/045 208/50 |
| 2010/0176029 | A1 | 7/2010 | Subbiah et al. | |
| 2016/0319199 | A1* | 11/2016 | Kawachi | C10B 57/045 |
| 2017/0029720 | A1 | 2/2017 | Koseoglu | |
| 2018/0016503 | A1* | 1/2018 | Prasad | C10G 9/005 |
| 2019/0382662 | A1* | 12/2019 | Das | C10G 9/005 |
| 2021/0171835 | A1* | 6/2021 | Chu | C10B 57/045 |

OTHER PUBLICATIONS

European Office Action dated Oct. 18, 2022 as receive in application No. 21196889.6.
Semir Eser: "A laboratory study of a pretreatment approach to a-sulfur FCC decant oils as feedstocks for commercial needle oil" Energy & Fuels, Sep. 28, 2007.
Indian Examination Report dated Apr. 25, 2022 as receive in application No. 202021040506.

* cited by examiner

PROCESS FOR PRODUCTION OF NEEDLE COKE

FIELD OF THE INVENTION

The present invention describes a process for production of graphite/needle grade coke with reduced impurity levels and improved coefficient of thermal expansion using an integrated hydrotreatment, catalytic cracking and coking reaction sections employing a synergistic combination of a highly paraffinic hydro-treated vacuum gasoil stream and an aromatic clarified oil (CLO) stream, without need for pre-treatment. Moreover, the present invention also provides an integration of VGO hydrotreater unit and fluid catalytic cracking unit which increases the efficiency of catalyst removal from CLO stream as well as process heat integration.

BACKGROUND OF THE INVENTION

Graphite/Needle grade coke is a premium grade petroleum coke, which is used in manufacturing of graphite electrodes for arc furnaces in steel industry. A good quality of needle coke is hard and dense mass formed with a structure of carbon threads or needles oriented in a single direction (flow direction). This coke is highly crystalline and provides the properties needed for manufacturing graphite electrode. Needle coke can withstand temperatures as high as 2800° C. Crystallinity affects the most important properties of the graphite electrodes such as coefficient of thermal expansion (CTE) and electrical resistivity. There are various grades of graphite/needle coke depending on its properties/specifications.

US Patent Application No. 20170029720 by Saudi Arabian Oil Co. provides an integrated process for producing de-asphalted oil, high quality petroleum green coke and liquid Coker products. An enhanced solvent de-asphalting process is used to treat the feedstock to reduce the level of asphaltenes, N, S and metal contaminants and produce deasphalted oil with reduced contaminants. A coking process is integrated to produce liquid and gas coking unit products, and petroleum green coke.

U.S. Pat. No. 9,375,656 by Philips 66 Co. describes methods for producing a Needle coke precursor from slurry oil having low levels of nitrogen and sulfur. Nitrogen-containing compounds are removed by chromatography, followed by hydro-treating at relatively mild conditions that focus on the more easily removed sulfur-containing compounds while largely preserving aromatic content of the slurry oil. The resulting Needle coke precursor can be converted to a premium Needle coke in a delayed coking system.

US Patent Application No. 20100176029 by Philips 66 Co. provides a method and apparatus for reducing content of nitrogen-containing compounds within slurry oil using a chromatographic based assembly, which may not affect aromatic content, prior to feeding the slurry oil into a coking system. The slurry oil passes through the chromatographic based assembly to upgrade the slurry oil and make the slurry oil suitable for feedstock in making Needle coke. Further, a hydrotreater utilized in combination with the chromatographic based assembly may provide additional upgrading of the slurry oil.

U.S. Pat. No. 5,286,371A by BP Corp North America Inc. discloses a process for producing premium and super premium grade needle coke comprising the steps of passing a heavy resid feedstock to a resid hydrotreating reaction zone at resid hydrotreating conditions and producing light resid hydrotreated products and a heavy resid hydrotreated residual product, directing the heavy resid hydrotreated residual product and FCC decanted oil to a solvent extraction process reaction zone at solvent extraction process conditions and producing products comprising a solvent extracted oil and resin stream and a stream comprising asphaltenes, and conveying at least a portion of the solvent extracted oil and resin stream to a delayed coking process at delayed coking conditions and producing liquid products and premium grade coke.

CN Patent No. 1309164A by China Petrochemical Corporation discloses a process for combining hydrogenating residue with delayed coking and includes steps such as mixing residue, coked gas oil and hydrogen together, hydrogenation reaction in the presence of catalyst, separating the hydrogenated resultant, delayed coking of hydrogenated residue individually or along with conventional raw materials for preparing needle coke, separating coked resultant, and returning the coked gas oil back to hydrogenation equipment.

Semih Eser et al. examines a commercial pretreatment approach where the feedstock to the fractionator column includes a hydrotreated fraction (HYD) and a vacuum tower bottom (VTB) fraction of a decant oil. Samples of two sets of decant oils including the corresponding HYD, VTB, and CF derivatives were analyzed and carbonized in laboratory reactors to monitor mesophase development from these materials. The CF, HYD, and VTB samples produced higher degrees of mesophase development than that obtained from the parent DO.

From the referred prior arts, it can be seen that attempts have been made to increase the quality of Needle Coke by trying to purify the Needle Coker feedstock employing various techniques like solvent deasphalting to remove the impurities as in US20170029720, chromatographic purification as in U.S. Pat. No. 9,375,656 and US20100176029. These process routes require additional process hardware and processing steps of the Needle Coker feedstock like slurry oil (CLO). These further processing steps of the slurry oil are primarily aimed towards reducing the impurity content like sulfur, nitrogen etc., which impacts the final Needle coke quality. When CLO is subjected to a hydrotreatment/solvent treatment step, the aromatic molecule of the CLO gets either saturated or partly removed.

SUMMARY OF THE INVENTION

It can be seen that if the impurity contents like sulfur and nitrogen are in higher levels than desired in the CLO feedstock employed for production of needle coke, different purification/treatment processes such as hydro-treatment or solvent de-asphalting etc., are employed to reduce these levels and prevent the increase in the levels of these impurities in the generated needle coke. It is also desired to improve the CTE of the needle coke which is produced from a pure CLO based feedstock. Further, it is observed from commercial high severity fluid catalytic unit operations, that several operational issues in fractionator bottom sections are faced by the operating personnel while operating the unit at higher severities generating highly aromatic CLO products such as, lesser CLO yields, high concentration of catalyst fines in CLO, lack of adequate levels in fractionator bottom section, requirement of dropping of light cycle oil (LCO) to the bottom section, higher temperature in the fractionator bottom, higher coking rates in the fractionator bottom section, etc. Therefore, it is desirable to have a novel process which addresses the above-mentioned plethora of issues.

TECHNICAL ADVANTAGES OF THE INVENTION

The present invention has the following advantages over the cited prior arts:

1. Utilizes an integration of VGO hydrotreater unit and Fluid catalytic cracking unit to generate a combination of highly paraffinic hydrotreated VGO stream in combination with highly aromatic CLO
2. Achieves improvement in needle coke quality without employing any additional process or hardware for treatment or purification of CLO feedstock, thereby eliminating any need of additional capital and operating expenditure
3. A method to improve the filtration efficiency for removal of catalyst fines from the aromatic CLO stream along with managing the lighter boiling hydrocarbons in the needle coker feedstock
4. Addresses the issue of deterioration of coke quality generated from very high aromatic CLO feedstock containing higher levels of impurities like sulfur, nitrogen, etc., without the need of pretreatment of the CLO stream
5. Reduces the coking tendency in the bottom section of the fractionator column of fluid catalytic cracking unit and eliminates the need for dropping of Light Cycle Oil (LCO) to the CLO stream.

OBJECTIVES OF THE PRESENT INVENTION

It is a primary objective of the present invention which relates to a process for production of graphite/needle grade coke with reduced impurity levels and improved coefficient of thermal expansion (CTE) using an integrated hydrotreatment and coking reaction sections employing a synergistic combination of a highly paraffinic hydrotreated stream and an aromatic clarified oil stream, without the need for pretreatment.

It is a further objective of the present invention to provide an integration of VGO hydrotreater unit and Fluid catalytic cracking unit, which increases the efficiency of catalyst removal from CLO, improved process heat integration, reduce coking in the fractionator bottom section and manage distillation units and processes.

Further another object of this invention is that it relates to delayed coking process for production of needle coke.

DETAILED DESCRIPTION OF THE INVENTION

Figure 1:
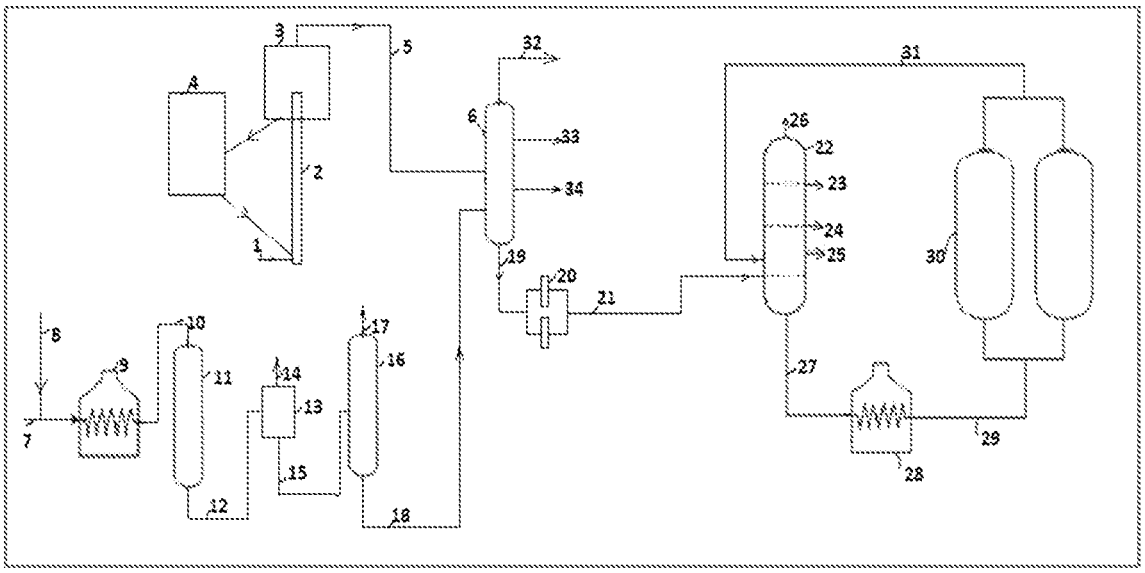
FIG. 1 illustrates a schematic process flow diagram of the invented process.

Those skilled in the art will be aware that the present disclosure is subject to variations and modifications other than those specifically described. It is to be understood that the present disclosure includes all such variations and modifications. The disclosure also includes all such steps of the process, features of the system, referred to or indicated in this specification, individually or collectively, and any and all combinations of any or more of such steps or features.

Definitions

For convenience, before further description of the present disclosure, certain terms employed in the specification, and examples are collected here. These definitions should be read in the light of the remainder of the disclosure and understood as by a person of skill in the art. The terms used herein have their meanings recognized and known to those of skill in the art, however, for convenience and completeness, particular terms and their meanings are set forth below.

The articles "a", "an" and "the" are used to refer to one or to more than one (i.e., to at least one) of the grammatical object of the article.

The terms "comprise" and "comprising" are used in the inclusive, open sense, meaning that additional elements may be included. It is not intended to be construed as "consists of only".

Throughout this specification, unless the context requires otherwise the word "comprise", and variations such as "comprises" and "comprising", will be understood to imply the inclusion of a stated element or step or group of element or steps but not the exclusion of any other element or step or group of element or steps.

The term "including" is used to mean "including but not limited to". "Including" and "including but not limited to" are used interchangeably.

Unless defined otherwise, all technical and scientific terms used herein have the same meaning as commonly understood by one of ordinary skill in the art to which this disclosure belongs. Although any methods and materials similar or equivalent to those described herein can be used in the practice or testing of the disclosure, the preferred methods, and materials are now described. All publications mentioned herein are incorporated herein by reference.

The present disclosure is not to be limited in scope by the specific embodiments described herein, which are intended for the purposes of exemplification only. Functionally equivalent products and methods are clearly within the scope of the disclosure, as described herein.

The present invention provides a process for production of graphite/needle grade coke using a highly paraffinic hydrotreated VGO stream mixed with CLO stream without employing any heat soaking step. The invention also provides an integration of VGO hydrotreater unit and Fluid catalytic cracking unit which increases the efficiency of catalyst removal from CLO stream as well as process heat integration. The invention also relates to the delayed coking process for production of needle coke.

In an embodiment of the invention, the present invention provides a process for production of graphite/needle grade coke with reduced impurity levels and improved coefficient of thermal expansion, wherein the process comprises (a) routing a VGO feed (1) to a riser reactor (2) of a fluid catalytic cracking unit, wherein the VGO feed reacts with a hot catalyst supplied from a regenerator (4); (b) products of reaction from step (a) along with a catalyst are sent to a stripper (3) for separation of a hydrocarbon vapor product (5) from the catalyst; (c) the hydrocarbon vapor product (5) is sent to a first fractionator column (6) for separation into different products like off gases with naphtha (32), LCO (33), and HCO (34); (d) a VGO stream (7) is mixed with H2 (8) and is sent to a furnace (9) for heating; (e) hot feeds (10) from step (d) are sent to a fixed bed reactor (11), wherein the hydrotreatment of a vacuum gas oil occurs and reaction products (12) are sent to a high-pressure separator (13) where lighter gases (14) are removed and sent to a low-pressure separator; (f) remaining liquid (15) is sent to a second fractionator column (16) for further separation of lighter products (17); (g) a hydrotreated VGO stream (18) from the second fractionator column (16) is routed to a bottom section of the first fractionator column (6), wherein it is mixed with a CLO product fraction generated in the fluid catalytic cracking unit; (h) heat exchange between the hydrotreated VGO stream (18) and the CLO product fraction occurs in the bottom section of the first fractionator column (6) and a homogenous mixture is formed; (i) the homogenous mixture is sent through a parallel filtration assembly (20) for separation of entrained catalyst fines present coming through the CLO product fraction; and (j) the homogenous mixture after catalyst removal is routed to a third fractionator column (22) of a delayed coking section.

In another embodiment of the invention, any lighter fraction in the hydrotreated VGO stream (18) boiling at a temperature of not more than 350° C. is separated in the first fractionator column (6).

In yet another embodiment of the invention, the homogenous mixture is mixed with an internal recycle fraction in the third fractionator column (22) of the delayed coking section and is withdrawn from the third fractionator column (22) as a secondary feed (27).

Further, in an embodiment of the invention, the secondary feed (27) is heated in a furnace (28) and a hot feed (29) is produced. This hot feed (29) is sent to a coke drums (30) for delayed coking reaction.

In an embodiment of the invention, a vapor product (31) generated in the coke drums (30) is sent to the third fractionator column (22) for further separation into various streams like off gas with naphtha (26), LCGO (23), HCGO (24) and CFO (25). The needle coke produced in the coke drums (30) is removed after a filling cycle by high pressure water jet cutting.

Additionally, an embodiment of the above process is that rather than sending the hydrotreated VGO stream (18) from the second fractionator column to the bottom section of the first fractionator column (6) where it is mixed with the CLO product fraction generated in the fluid catalytic cracking reactions, the aromatic CLO stream (60) is injected at the bottom section of the second fractionator column (59), which mixes with the hydrotreated VGO product.

In yet another embodiment of the invention, the sulfur content of the CLO product fraction is not more than 1 wt % and sulfur content of the hydrotreated VGO stream is not more than 0.4 wt %. Also, the weight percentage of the hydrotreated VGO stream in the homogenous mixture is present in a range of 1-50 wt %.

In an embodiment of the invention, the present invention provides an integrated system for production of graphite/needle grade coke, comprising of (a) a fluid catalytic cracking unit comprising (i) a riser reactor (2); (ii) a regenerator (4); and (iii) a stripper (3) for separation of vapor product (5); (b) a VGO hydrotreater comprising (i) a furnace (9); (ii) a fixed bed reactor (11) for hydrotreatment of vacuum gas oil; (iii) a high-pressure separator (13); and (iv) a second fractionator column (16) for separation of lighter products (17); (c) a first fractionator column (6), wherein a hydrotreated VGO stream (18) from the second fractionator column (16) is mixed with a CLO product fraction generated in the fluid catalytic cracking unit; (d) a parallel filtration assembly (20) for separation of entrained catalyst fines present coming through the CLO product fraction; and (e) a delayed coking section comprising (i) a third fractionator column (22); (ii) a furnace (28); and (iii) coke drums (30).

In yet another embodiment of the invention, the VGO hydrotreater unit is operated at a reactor pressure in a range of 30-55 Kg/cm2 (g) and a temperature in a range of 300-380° C. The fluid catalytic cracking unit is operated at a high reactor outlet temperature of 550 to 650° C., preferably between 580 to 620° C. Reactor pressure shall vary in the range of 0.7 to 2.5 Kg/cm$^2$ (g), preferably in the range of 0.8 to 1.5 Kg/cm$^2$ (g). The catalyst to oil ratio is selected from a range of 10 to 25, preferably in the range of 15 to 20. Further, the delayed coking process is operated at a temperature in a range of 460-515° C., drum pressure in a range of 2-10 Kg/cm2 (g) and cycle time of 18-42 hrs.

Feedstock:

The hydrocarbon feedstock to be used in the process is selected from hydrocarbon feed streams like CLO, Coal tar pitch and hydrotreated VGO, wherein the hydrotreated VGO stream has lesser impurities like sulfur, nitrogen, etc., compared to the other feedstocks in the mixture. The feedstock to the fluid catalytic cracking unit for production of CLO is selected from hydrocarbon streams like VGO, hydrotreated VGO, atmospheric residue, etc. The sulfur content of the CLO is 1 wt % (max.) and that of hydrotreated VGO is 0.4 wt % (max.).

Process Conditions:

The VGO hydrotreater unit is operated at a reactor pressure in the range of 30-55 Kg/cm2 (g) and temperature of 300-380° C. The fluid catalytic cracking unit is operated at a high reactor outlet temperature of 550 to 650° C. Reactor pressure shall vary in the range of 0.7 to 2.5 Kg/cm$^2$ (g). The catalyst to oil ratio is kept in the range of 10 to 25. The Delayed coking process section is carried out at a temperature range of 460-515° C., Drum pressure of 2-10 Kg/cm2 (g) and cycle time of 18-42 hrs. The weight percentage of Hydrotreated VGO in the mixture with CLO is kept in the range of 1-50 wt %, while feeding into the fractionator bottom section of the fluid catalytic cracking unit.

Process Description:

The process of the present invention is exemplified by, but not limited to the following figures.

A schematic process flow diagram of the invented process is provided as FIG. 1. According to the main embodiment, VGO feed (1) is routed to the Riser reactor (2) of the fluid catalytic cracking unit where it reacts in contact with the hot catalyst supplied from the Regenerator (4) and the product of reactions along with catalyst are sent to the Stripper (3) for separation of the vapor product (5) from the catalyst. The hydrocarbon vapor product is sent to the first fractionator column (6) for separation into different products like off gases with naphtha (32), LCO (33), HCO (34), etc. Meanwhile, a VGO stream (7) is mixed with $H_2$ (8) and is sent to a furnace (9) for heating. The hot feeds (10) are sent to a fixed bed reactor (11) where the hydro-treatment of the vacuum gas oil occur, and the reaction products (12) are sent to a high-pressure separator (13) where the lighter gases (14) are removed and sent to a low-pressure separator. The remaining liquid (15) is sent to a second fractionator column (16) for separation of further lighter products (17). The hydrotreated VGO stream (18) from the second fractionator column is routed to the bottom section of the first fractionator column (6) where it is mixed with the CLO product fraction generated in the fluid catalytic cracking reactions. In the bottom section of the said fractionator, the heat exchange between hydrotreated VGO and the CLO streams occur and form a homogeneous mixture. Any lighter fraction in the hydrotreated VGO boiling below 350° C. is separated in the said fractionator column. The combined mixed feed is then sent through the parallel filtration assembly (20) for separation of entrained catalyst fines present coming through the CLO stream. The mixed feed stream (21) after catalyst removal is routed to a third fractionator column (22) of the Delayed Coking section. In the bottom section of the third fractionator column, the mixed feedstock is mixed with the internal recycle fraction and is withdrawn from the column as the secondary feed (27). The secondary feed is heated in a furnace (28) and the hot feed (29) is sent to the coke drums (30) for delayed coking reactions. The vapor product (31) generated in the coke drums is sent to the fractionator column (22) for further separation into various streams like off gas with naphtha (26), LCGO (23), HCGO (24) and CFO (25). Needle coke which is produced in the coke drums are removed after a filling cycle by high pressure water jet cutting.

Figure 2:
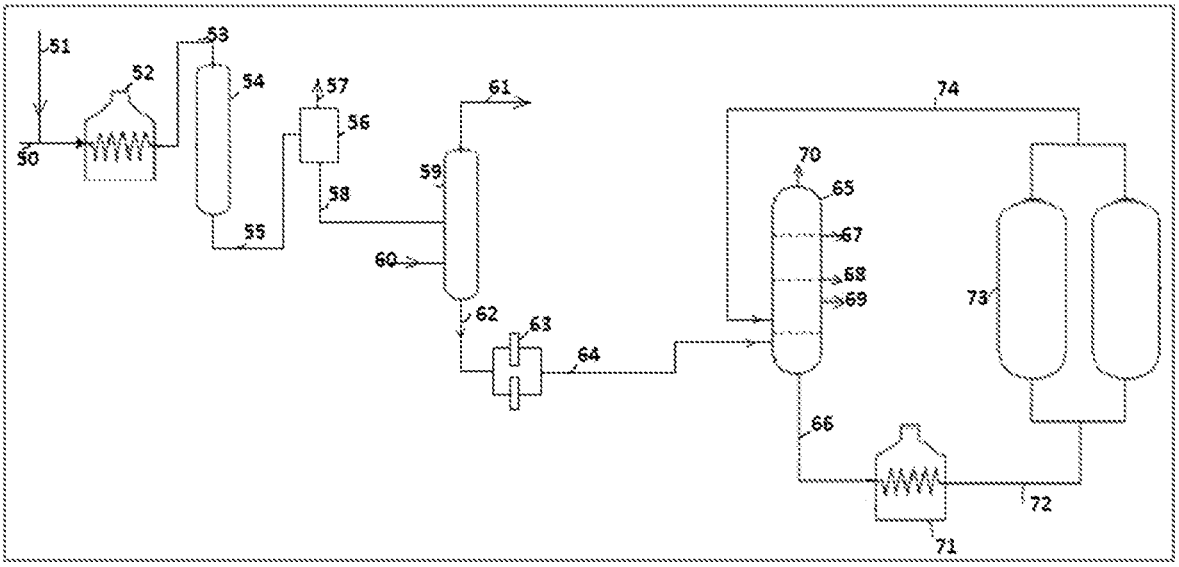
FIG. 2 illustrates an embodiment of the invented process.

An embodiment of the present invention is provided in FIG. 2. VGO stream (50) is mixed with $H_2$ (51) and is sent to a furnace (52) for heating. The hot feeds (53) are sent to a fixed bed reactor (54) where the hydro-treatment of the vacuum gas oil occur, and the reaction products (55) are sent to a high-pressure separator (56) where the lighter gases (57) are removed and sent to a low-pressure separator. The remaining liquid (58) is sent to a second fractionator column (59) for separation of further lighter products (61). At the bottom section of the fractionator column, aromatic CLO stream (60) is injected, which mixes with the hydrotreated VGO product and the mixed feedstock (62) is then subjected to filtration (63) for separation of entrained catalyst fines present coming through the CLO stream. The mixed feed stream (21) after catalyst removal is routed to a third fractionator column (65) of the Delayed Coking section. In the bottom section of the third fractionator column, the mixed feedstock is further mixed with the internal recycle fraction and is withdrawn from the column as the secondary feed (66). The secondary feed is heated in a furnace (71) and the hot feed (72) is sent to the coke drums (73) for delayed coking reactions. The vapor product (74) generated in the coke drums is sent to the fractionator column (65) for further separation into various streams like off gas with naphtha (70), LCGO (67), HCGO (68) and CFO (69). Needle coke which is produced in the coke drums are removed after a filling cycle by high pressure water jet cutting.

EXAMPLES

Having described the basic aspects of the present invention, the following non-limiting examples illustrate specific embodiment thereof. Those skilled in the art will appreciate that many modifications may be made in the invention without changing the essence of invention. The process of present invention is exemplified by the following non-limiting examples.

In order to validate the process of present invention, aromatic CLO and hydrotreated VGO stream were collected, and the properties were analyzed, and the results are provided in the Table 1.

TABLE 1

Properties of feedstock

| Property | CLO | HDT VGO |
|---|---|---|
| Density, g/cc | 1.1095 | 0.8991 |
| CCR, wt % | 6.1 | 0.05 |

TABLE 1-continued

Properties of feedstock

| Property | CLO | HDT VGO |
|---|---|---|
| Asphaltene | 0.48 | 0.01 |
| Sulfur, wt % | 0.32 | 0.04 |
| Nitrogen, wt % | 0.077 | 0.016 |
| Aromatics, wt % | 98.2 | 19.3 |
| Paraffins + Naphthenes, wt % | 1.8 | 80.7 |

In order to find out the Needle Coke quality which can be generated from the CLO stream alone, thermal cracking experiment (Run-1) using the same was carried out in a 1 bbl/day capacity Delayed Coker Pilot Plant. A furnace outlet temperature of 495° C. along with a pressure of 3 Kg/cm2 (g) was carried out.

In order to simulate the integration of the VGO hydrotreater and FCCU, both the CLO and HDT VGO streams were blended offline at the desired ratios of 10 wt % and 20 wt % and thermal cracking experiments (Run-2 & Run-3) were carried out at the same experimental conditions as Run-1.

The green coke samples generated from all runs were collected and subjected to calcination in a laboratory coke calciner unit and the properties like Coefficient of Thermal Expansion (CTE), Sulfur content and Nitrogen content were measured. The experimental results are provided in the Table-2. Therefore, experiments were carried out in DCU pilot plant using the neat CLO as well as mixtures of CLO+HDT VGO streams at identified operating conditions which are maintained same for all the runs. The yields from the experiments along with the characteristics of the calcined coke samples are provided in the Table-2.

TABLE 2

Results of Delayed Coking experiments

| Parameter | Run-1 | Run-2 | Run-3 |
|---|---|---|---|
| Feed | CLO | CLO + 10% HDT VGO | CLO + 20% HDT VGO |
| Gas, wt % | 7.5 | 6.6 | 7.7 |
| Distillates, wt % | 51.4 | 60.5 | 60.3 |
| Coke, wt % | 41.1 | 32.9 | 32 |
| CTE, $10^{-6}$/° C. | 1.35 | 1.31 | 1.26 |
| Coke sulfur, wt % | 0.41 | 0.38 | 0.33 |
| Coke nitrogen, wt % | 0.15 | 0.14 | 0.12 |

From the Table-2, it can be seen that the CTE value of the Needle Coke improved from $1.35\times10^{-6}$/° C. in case of neat CLO to $1.26\times10^{-6}$/° C. in case of mixture of CLO+20% HDT VGO stream. In case of impurity content like sulfur, there is decrease of ~0.08 wt % from the initial value of 0.41 wt %. Similar decrease in nitrogen content was also observed from 0.15 wt % to 0.12 wt % in the feed case with 20 wt % blending of HDT VGO in CLO stream. This indicates that it is feasible to produce needle coke of better quality in terms of lower sulfur/nitrogen impurity levels as well as CTE by the invented process.

The invention claimed is:

1. A process for production of graphite/needle grade coke with reduced impurity levels and improved coefficient of thermal expansion, wherein the process comprises:

(a) routing a vacuum gas oil (VGO) feed to a riser reactor of a fluid catalytic cracking unit, wherein the VGO feed reacts with a hot catalyst supplied from a regenerator, and wherein the fluid catalytic cracking unit is operated at a reactor outlet temperature of 550 to 650° C., at a pressure in a range of 0.7 to 2.5 Kg/cm$^2$ (g) and having a catalyst to oil ratio in a range of 10 to 25;

(b) sending products of reaction from step (a) along with a catalyst to a stripper for separation of a hydrocarbon vapor product from the catalyst;

(c) sending the hydrocarbon vapor product to a first fractionator column for separation into different products comprising off gases with naphtha, light cycle oil (LCO), and heavy cycle oil (HCO);

(d) mixing a VGO stream with $H_2$ and sending to a furnace for heating to obtain a hot feed;

(e) sending the hot feed from step (d) to a fixed bed reactor, wherein hydrotreatment of the VGO stream occurs to obtain a hydrotreated VGO stream at a reactor pressure in a range of 30-55 Kg/cm$^2$ (g) and a temperature in a range of 300-380° C., and wherein reaction products are sent to a high-pressure separator where lighter gases are removed and sent to a low-pressure separator;

(f) sending a liquid after removing the lighter gases from the reaction products to a second fractionator column for further separation of lighter products;

(g) routing a stream consisting of the hydrotreated VGO stream from the second fractionator column and a clarified oil (CLO) product fraction to a bottom section of the first fractionator column, wherein the clarified oil (CLO) product fraction is generated in the fluid catalytic cracking unit, wherein the hydrotreated VGO stream comprises aromatics about 19 wt % and a mixture of paraffins and naphthenes about 80 wt %, wherein the CLO product fraction comprises aromatics about 98 wt % and a mixture of paraffins and naphthenes about 2 wt %;

(h) exchanging heat between the hydrotreated VGO stream and the CLO product fraction occurring in the bottom section of the first fractionator column and forming a homogenous mixture, wherein a lighter fraction in the hydrotreated VGO stream boiling at a temperature of not more than 350° C. is separated in the first fractionator column, wherein weight percentage of the hydrotreated VGO stream in the homogenous mixture is in a range of 20-50 wt %;

(i) sending the homogenous mixture through a parallel filtration assembly for separation of entrained catalyst fines present; and (j) routing the homogenous mixture after catalyst removal to a third fractionator column of a delayed coking section.

2. The process as claimed in claim 1, wherein the homogenous mixture is mixed with an internal recycle fraction in the third fractionator column of the delayed coking section and is withdrawn from the third fractionator column as a secondary feed.

3. The process as claimed in claim 2, wherein the secondary feed is heated in a furnace and a hot feed is produced.

4. The process as claimed in claim 3, wherein the hot feed is sent to coke drums operated at a temperature in a range of 460-515° C., drum pressure in a range of 2-10 Kg/cm$^2$ (g) and cycle time of 18-42 hrs for delayed coking reaction.

5. The process as claimed in claim 1, wherein a vapor product generated in the coke drums is sent to the third fractionator column for further separation into various streams comprising off gas with naphtha, light coker gas oil (LCGO), heavy coker gas (HCGO) and coker fuel oil (CFO).

6. The process as claimed in claim 1, wherein a needle coke produced in the coke drums is removed after a filling cycle by high pressure water jet cutting.

7. The process as claimed in claim 1, wherein after step (f) an aromatic CLO stream is injected at a bottom section of the second fractionator column to mix with the hydrotreated VGO stream.

8. The process as claimed in claim 1, wherein sulfur content of the CLO product fraction is not more than 1 wt % and sulfur content of the hydrotreated VGO stream is not more than 0.4 wt %.

* * * * *